US008909119B2

(12) United States Patent
Miyahara et al.

(10) Patent No.: US 8,909,119 B2
(45) Date of Patent: Dec. 9, 2014

(54) FIXING MEMBER AND MANUFACTURING METHOD THEREOF

(71) Applicant: Canon Kabushiki Kaisha, Tokyo (JP)

(72) Inventors: Yasuhiro Miyahara, Tokyo (JP); Naoki Akiyama, Toride (JP); Hiroto Sugimoto, Toride (JP); Takeshi Suzuki, Yokohama (JP); Yuji Hasegawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/064,335

(22) Filed: Oct. 28, 2013

(65) Prior Publication Data

US 2014/0119789 A1 May 1, 2014

(30) Foreign Application Priority Data

Oct. 29, 2012 (JP) ..... 2012-237942

(51) Int. Cl.
*G03G 15/20* (2006.01)

(52) U.S. Cl.
CPC ..... *G03G 15/206* (2013.01)
USPC ..... 399/329; 399/333

(58) Field of Classification Search
CPC ..... G03G 15/2053; G03G 15/206
USPC ..... 399/329, 333
See application file for complete search history.

(56) References Cited

U.S. PATENT DOCUMENTS

| | | | | |
|---|---|---|---|---|
| 6,733,943 | B2 * | 5/2004 | Finn et al. | 399/333 |
| 7,389,079 | B2 * | 6/2008 | Narahara et al. | 399/329 |
| 7,457,575 | B2 * | 11/2008 | Tsunoda | 399/329 |
| 7,725,066 | B2 * | 5/2010 | Kagawa | 399/333 |
| 7,725,068 | B2 | 5/2010 | Matsunaka et al. | |
| 7,991,341 | B2 | 8/2011 | Matsunaka et al. | |
| 8,606,163 | B2 * | 12/2013 | Yamamoto et al. | 399/329 |
| 2010/0155199 | A1 | 6/2010 | Ikeda et al. | |
| 2011/0045310 | A1 * | 2/2011 | Kishino et al. | 428/474.4 |
| 2013/0202333 | A1 | 8/2013 | Sugimoto | |
| 2014/0107250 | A1 | 4/2014 | Maeda et al. | |
| 2014/0116599 | A1 | 5/2014 | Miyahara et al. | |
| 2014/0116603 | A1 | 5/2014 | Akiyama et al. | |
| 2014/0116611 | A1 | 5/2014 | Akiyama et al. | |
| 2014/0116612 | A1 | 5/2014 | Akiyama et al. | |
| 2014/0119789 | A1 * | 5/2014 | Miyahara et al. | 399/333 |
| 2014/0120352 | A1 | 5/2014 | Miyahara et al. | |
| 2014/0133892 | A1 | 5/2014 | Miura et al. | |

FOREIGN PATENT DOCUMENTS

| | | | |
|---|---|---|---|
| JP | 2004-276290 | A | 10/2004 |
| JP | 2009-244887 | A | 10/2009 |
| JP | 2010-143118 | A | 7/2010 |

OTHER PUBLICATIONS

Non-Final Office Action in U.S. Appl. No. 14/064,328 (dated Jul. 10, 2014).

* cited by examiner

*Primary Examiner* — W B Perkey

(74) *Attorney, Agent, or Firm* — Fitzpatrick, Cella, Harper & Scinto

(57) ABSTRACT

A fixing member includes an elastic layer and a toner parting layer. The elastic layer includes a laser-irradiated region formed by being irradiated at longitudinal end portions of the elastic layer with laser light except for at least one non-laser-irradiated region with respect to a circumferential direction of the elastic layer. The elastic layer is coated with the toner parting layer.

13 Claims, 7 Drawing Sheets

FIXING MEMBER AND MANUFACTURING METHOD THEREOF

FIELD OF THE INVENTION AND RELATED ART

The present invention relates to a fixing member and a manufacturing method thereof.

As a fixing member for use with an image heating fixing device of an image forming apparatus of an electrophotographic type, such as a printer, a copying machine or a facsimile machine, there are a belt-shaped fixing member and a roller-shaped fixing member.

As these fixing members, a fixing member prepared by forming an elastic layer of a heat-resistant rubber or the like on a belt-shaped or roller-shaped substrate (support) of a heat-resistant resin or metal and then by providing, on a surface of the elastic layer, a fluorine-containing resin layer having an excellent parting property with respect to a toner has been known.

As such a fixing member, Japanese Laid-Open Patent (JP-A) 2004-276290 discloses a fluorine-containing resin tube coating roller prepared by inserting a roller substrate into a fluorine-containing resin tube enlarged in diameter and then by fixing the fluorine-containing resin tube and the roller substrate with an adhesive applied onto at least one of an inner peripheral surface of the fluorine-containing resin tube and another peripheral surface of the roller substrate.

Further, JP-A 2004-276290 discloses that the fluorine-containing resin tube formed by extrusion molding may preferably be used. Further, JP-A 2004-276290 discloses that as a thickness of the fluorine-containing resin tube, 50 μm or less is preferred in view of difficulty of deformation of the tube, and 20 μm or more is preferred from the viewpoints of a molding property, a performance of the tube as a roller during use, and the like.

Incidentally, in recent years, in the image forming apparatus of the electrophotographic type, in order to reduce an energy consumption amount during heat-fixing, further improvement in heat conduction efficiency of the fixing member has been required. For that reason, also with respect to the fluorine-containing resin tube, a thin fluorine-containing resin tube is required to be used.

Here, a thin seamless fluorine-containing resin tube of about 10-50 μm in thickness is capable of being formed by the extrusion molding. However, a fixing roller prepared by coating a cylindrical elastic layer with the thin seamless fluorine-containing resin tube formed by the extrusion molding and then by fixing the tube with an adhesive generated cracks or creases, with respect to a longitudinal direction of the fluorine-containing resin tube, with an increase in the number of sheets subjected to the heat-fixing.

With respect to this problem that the cracks or creases are generated, in JP-A 2010-143118, the reason why the cracks or creases are generated is presumed that in the thin seamless fluorine-containing resin tube obtained by the extrusion molding, fluorine-containing resin molecules are oriented (aligned) in the longitudinal direction of the tube to a high degree. For that reason, reduction in degree of orientation of the fluorine-containing resin molecules in the longitudinal direction of the fluorine-containing resin tube was attempted by annealing (treatment) of the fluorine-containing resin tube.

However, the degree of orientation of the fluorine-containing resin molecules in the longitudinal direction of the fluorine-containing resin tube correlates with a degree of crystallinity of the fluorine-containing resin tube. The thin fluorine-containing resin tube has a tendency that both of the degree of orientation and degree of crystallinity of the fluorine-containing resin (molecules) are high. The high degree of crystallinity itself is an advantageous characteristic since the generation of the creases on the surface of the fluorine-containing resin tube can be suppressed in the fixing member and a pressing member in which the fluorine-containing resin tube is to be repeatedly flexed by following the elastic layer.

As a method of lowering the degree of orientation while minimizing a lowering in degree of crystallinity of the thin seamless fluorine-containing resin tube formed by the extrusion molding, JP-A 2010-143118 discloses the following method.

That is, the fluorine-containing resin tube is formed by the extrusion molding so that the fluorine-containing resin tube has an inner diameter smaller than an outer diameter of the cylindrical elastic layer. The fluorine-containing resin tube is increased in diameter and then the cylindrical elastic layer is coated with the fluorine-containing resin tube, and thereafter a diameter-increased state of the fluorine-containing resin tube is maintained. Concurrently, the fluorine-containing resin tube is elongated in the longitudinal direction, and in that state, the fluorine-containing resin tube is heated on the elastic layer. As a result, even in a long-term use, the creases or cracks are not readily generated on the surface of the fluorine-containing resin tube, so that the fluorine-containing resin tube is capable of stably achieving a good fixing performance.

Further, in recent years, the fixing member has been required to realize further improvement in durable lifetime with demands for further reduction in running cost. When elongation of the durable lifetime is intended to be realized, a viewpoint such that peeling between the elastic layer and the fluorine-containing resin tube is suppressed is taken into consideration. As a reason why the peeling between the elastic layer and the fluorine-containing resin tube is caused, it would be considered that there are the following cases 1) and 2):

1) Case where the peeling is generated from a tube surface layer, as a starting point, on which the above-described creases or cracks are generated, and 2) Case where, separately from the case 1), the peeling is generated from a tube interface, as a starting point, between the elastic layer and the fluorine-containing resin tube at a belt end portion where a force, due to lateral belt deviation (shift), which is liable be directly exerted on the tube interface.

The constitution in JP-A 2010-143118 was a very effective method for suppressing the generation of the creases and cracks, but was not a constitution having a directly suppressing effect with respect to the tube peeling generated from the interface between the elastic layer and the fluorine-containing resin tube.

SUMMARY OF THE INVENTION

A principal object of the present invention is to provide a fixing member capable of achieving a good fixing performance and to provide a manufacturing method for manufacturing the fixing member.

According to an aspect of the present invention, there is provided a fixing member comprising: an elastic layer; and a toner parting layer, wherein the elastic layer includes a laser-irradiated region formed by being irradiated at longitudinal end portions of the elastic layer with laser light except for at least one non-laser-irradiated region with respect to a circumferential direction of the elastic layer, and wherein the elastic layer is coated with the toner parting layer.

According to another aspect of the present invention, there is provided a fixing member manufacturing method comprising: a step of forming a laser-irradiated region by irradiating an elastic material at longitudinal end portions of the elastic material with laser light of an oscillation wavelength λ of 120 nm≤λ10600 with at least one non-laser-irradiated region with respect to a circumferential direction; a step of applying an adhesive onto the elastic material on which the laser-irradiated region is formed; a step of coating a resin tube on the elastic material on which the adhesive is applied; and a step of fixing the resin tube by curing the adhesive.

These and other objects, features and advantages of the present invention will become more apparent upon a consideration of the following description of the preferred embodiments of the present invention taken in conjunction with the accompanying drawings.

Figure 3:
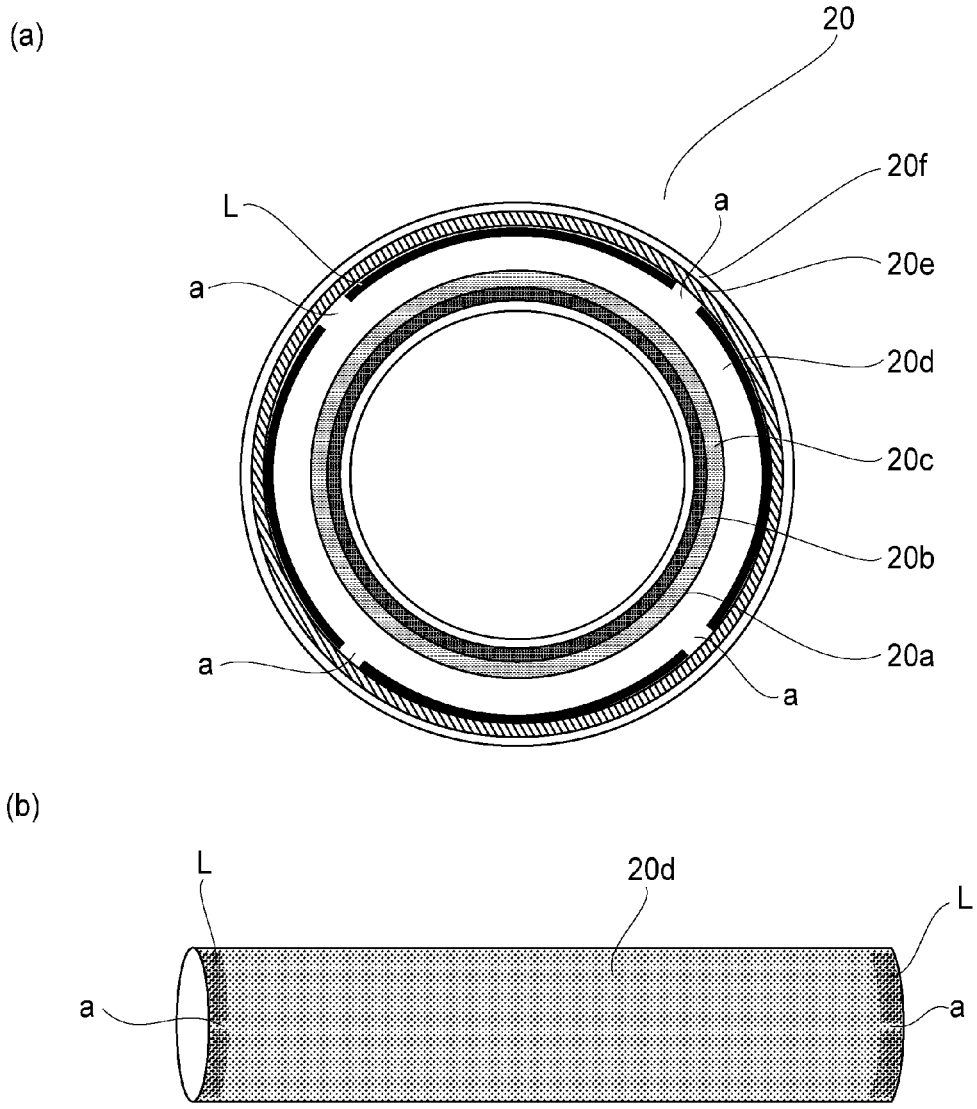

Parts (a) to (b) of FIG. 3 are schematic illustrations of a fixing belt.

Figure 4:
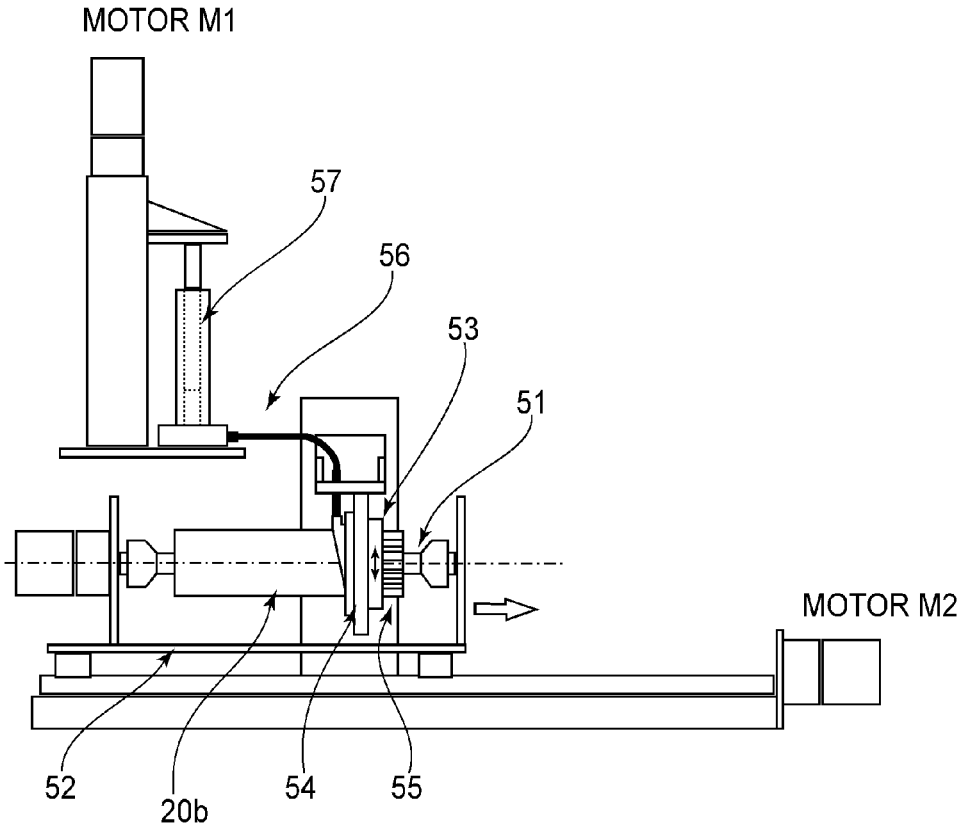

FIG. 4 is a schematic view of a coating (application) device using a ring-coating method.

Figure 5:
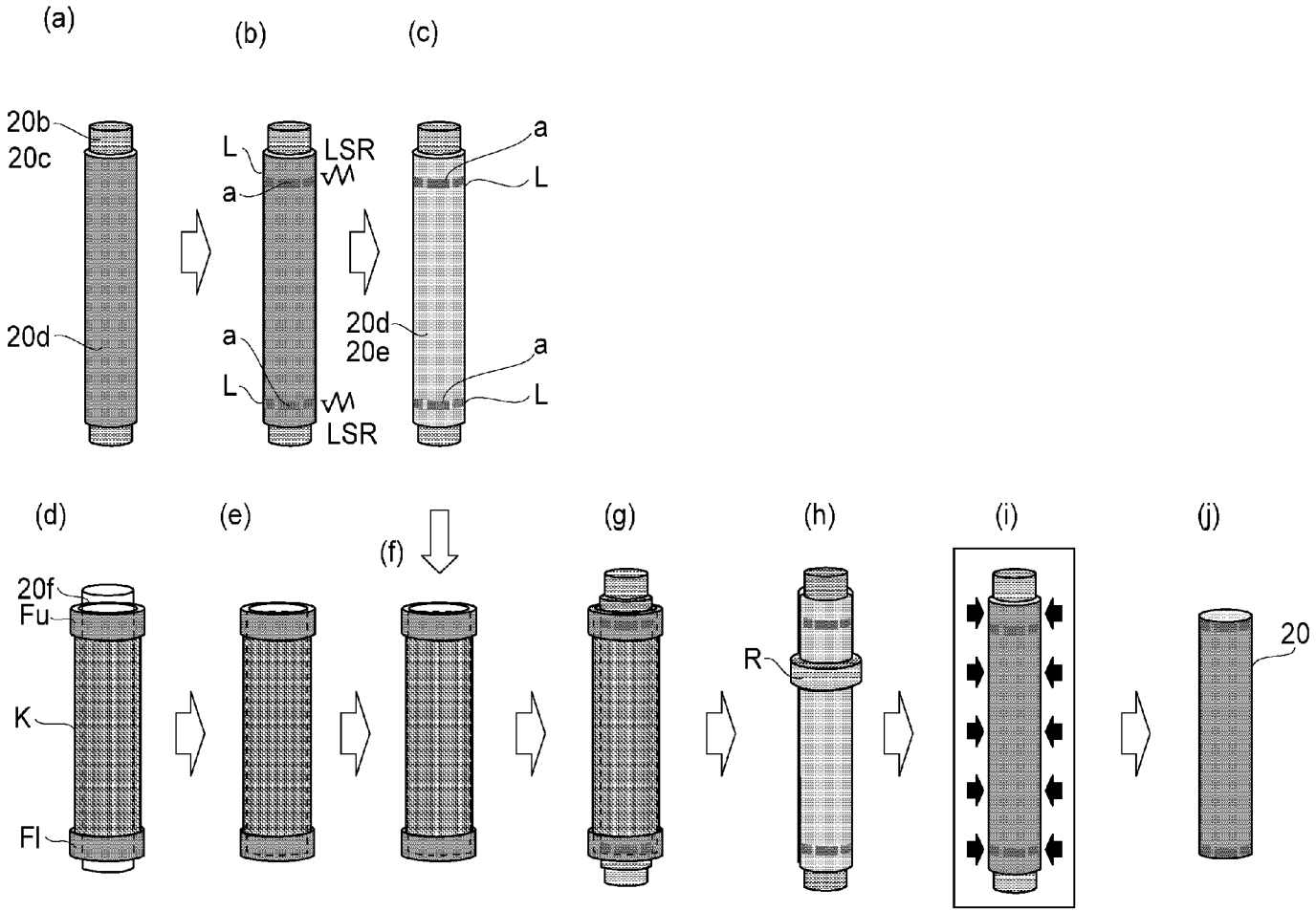

Parts (a) to (j) of FIG. 5 are schematic views for illustrating a coating step of a fluorine-containing resin tube in Embodiment 1 (extended coating method).

Figure 6:
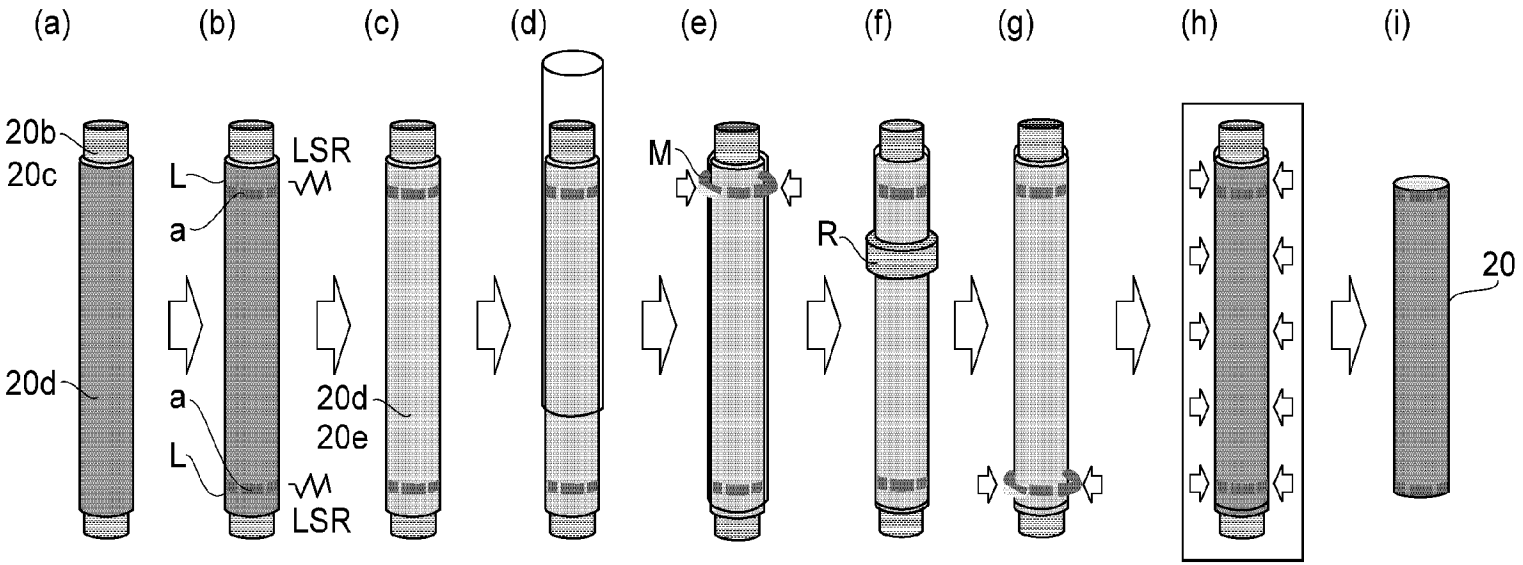

Parts (a) to (i) of FIG. 6 are schematic views for illustrating a coating step of a fluorine-containing resin tube in Embodiment 2 (lubricating coating method).

Figure 7:
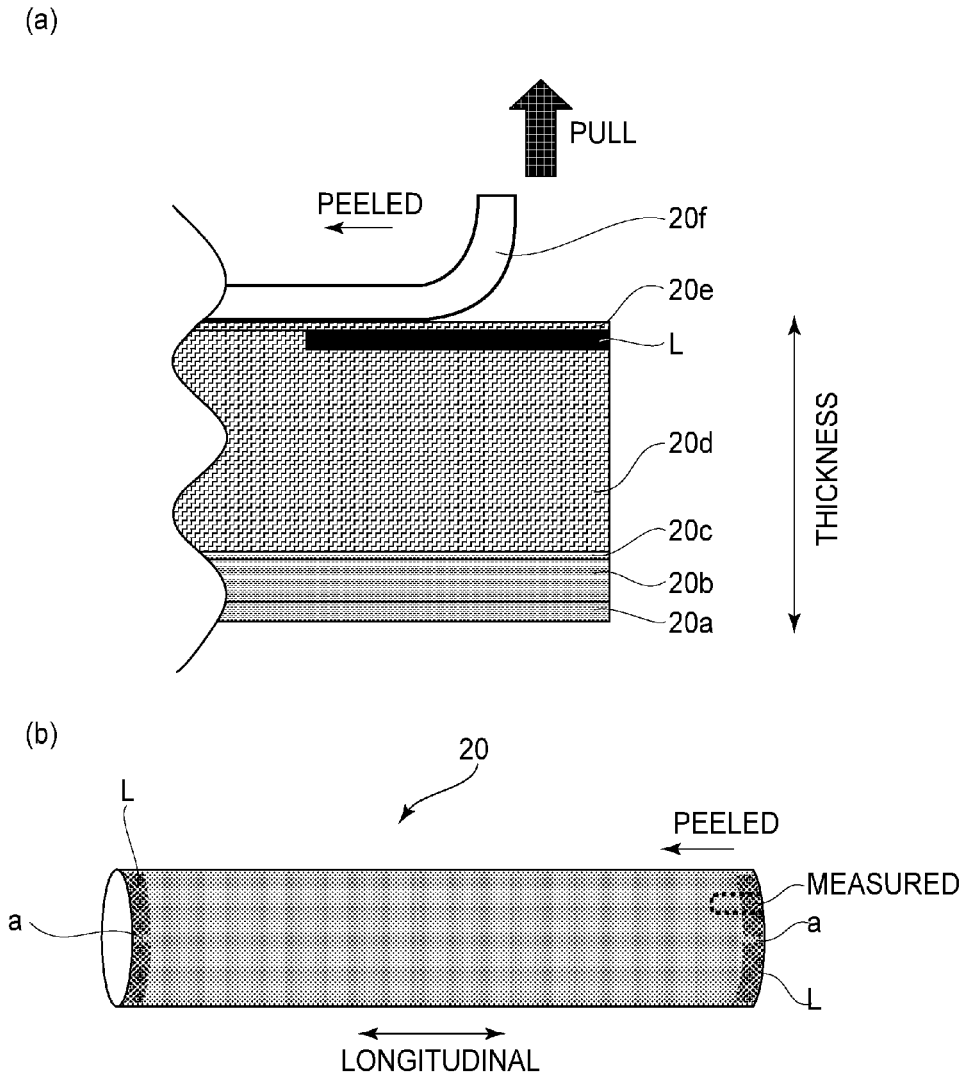

Parts (a) and (b) of FIG. 7 are schematic views for illustrating an adhesive property test used for evaluation of embodiments in the present invention.

DESCRIPTION OF THE PREFERRED EMBODIMENTS

Embodiments for carrying out the present invention will be described on the basis of a fixing belt as a fixing member for use with a fixing device, but the scope of the present invention is not limited to the embodiments, and also embodiments changed within a range not impairing the object (purpose) of the present invention is encompassed in the present invention.

Embodiment 1

(1) General Structure of Image Forming Apparatus

Figure 1:
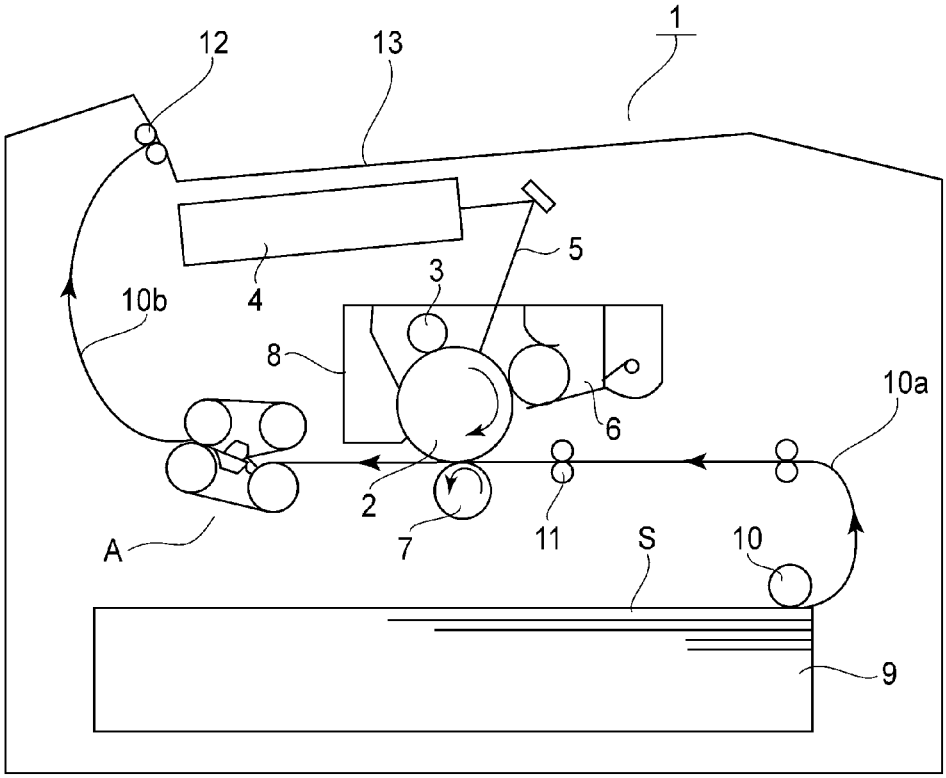
FIG. 1 is a schematic illustration of a general structure of an image forming apparatus.

FIG. 1 is a schematic illustration showing a general structure of an image forming apparatus used in this embodiment. An image forming apparatus 1 is a laser printer of an electrophotographic type and includes a photosensitive drum 2 as an image bearing member for bearing a latent image. The photosensitive drum 2 is rotationally driven in the clockwise direction at a predetermined peripheral speed, so that an outer surface of the photosensitive drum 2 is electrically charged uniformly to a predetermined polarity and a predetermined potential. The uniformed charged surface of the photosensitive drum 2 is exposed to laser light 5 based on image information by a laser scanner (optical device) 4. As a result, on the surface of the photosensitive drum 2, an electrostatic latent image corresponding to the image information of the laser light is formed.

The electrostatic latent image is developed as a toner image by a developing device 6. The toner image is successively transferred onto a recording material (sheet) S, introduced into a transfer portion as a contact portion between the photosensitive drum 2 and a transfer roller 7, at the transfer portion.

Sheets of the recording material S are stacked and accommodated in a sheet feeding cassette 9 provided at a lower portion of the image forming apparatus. At predetermined sheet feeding timing, when a sheet feeding roller 10 is driven, the sheets of the recording material S in the sheet feeding cassette 9 are separated and fed one by one, and then the separated and fed recording material S passes through a conveying passage 10*a* to reach a registration roller pair 11. The registration roller pair 11 receives a leading edge portion of the recording material S to rectify oblique movement of the recording material S. The recording material S is sent to the transfer portion in synchronism with the toner image on the photosensitive drum 2 so that timing when a leading end portion of the toner image on the photosensitive drum 2 reaches the transfer portion coincides with timing when also the leading edge portion of the recording material S just reaches the transfer portion.

The recording material S passing through the transfer portion is separated from the surface of the photosensitive drum 2, and then is conveyed into an image fixing device A. By the fixing device A, the unfixed toner image on the recording material S is fixed as a fixed image on the recording material surface under application of heat and pressure. Then, the recording material S passes through a conveying passage 10*b* and then is discharged and placed on a discharge tray 13, by a discharging roller pair 12, provided at an upper portion of the image forming apparatus. Further, the surface of the photosensitive drum 2 after the recording material separation is cleaned by removing a residual deposited matter such as a transfer residual toner by a cleaning device 9, thus being repetitively subjected to image formation.

(2) Fixing Device A

Figure 2:
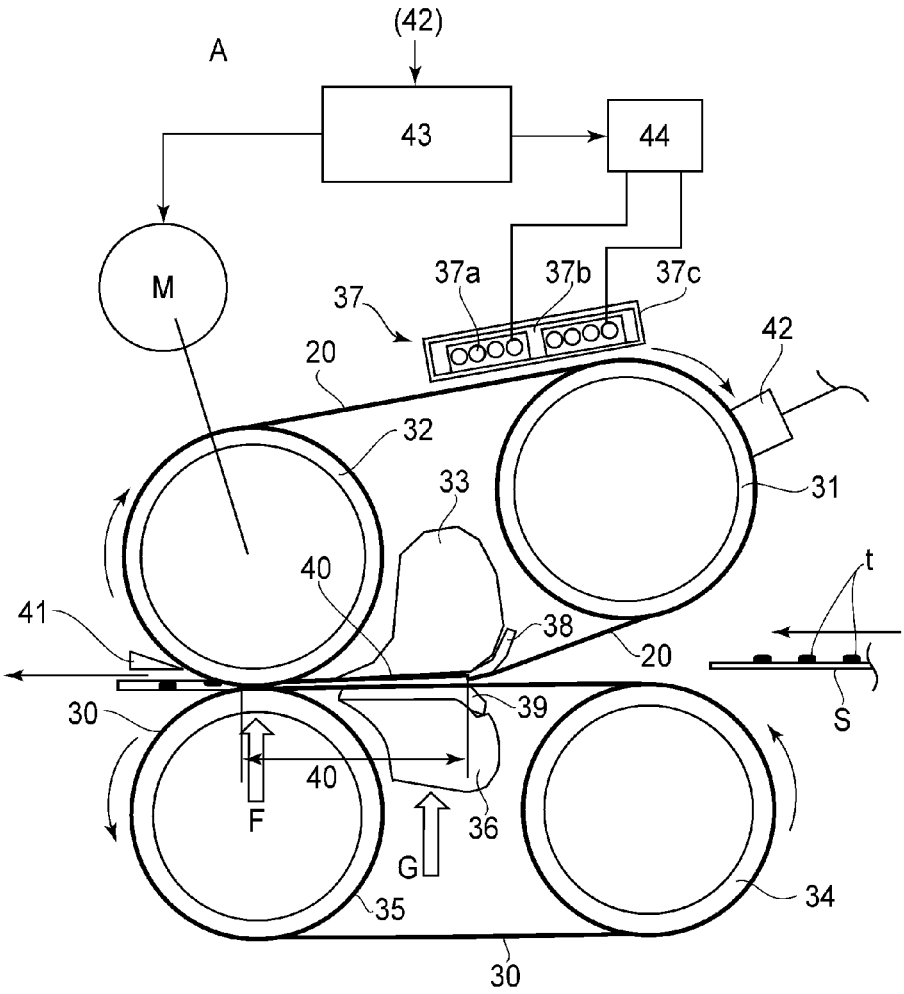
FIG. 2 is a schematic sectional view of a fixing device.

FIG. 2 is a schematic illustration showing a general structure of the image hating fixing device A. The fixing device A is of a twin belt type and of an electromagnetic induction heating type.

Here, with respect to the fixing device A and members constituting the fixing device A, a longitudinal direction refers to a direction parallel to a direction perpendicular to a recording material conveyance direction in a plane of a recording material conveying passage. With respect to the fixing device, a front (side or surface) refers to a side or surface in a recording material introducing side. Left and right refer to left and right as seen from the front side of the fixing device. A width of the belt refers to a dimension of the belt with respect to the direction perpendicular to the recording material conveyance direction, i.e., the dimension of the belt with respect to the longitudinal direction. A width of the recording material refers to a dimension of the recording material with respect to the direction perpendicular to the recording material conveyance direction in a plane of the recording material. Further, upstream and downstream refer to upstream and downstream with respect to the recording material conveyance direction.

The fixing device A includes a fixing belt (heating member) 20 as a first endless belt and a pressing belt (pressing member) 30 as a second endless belt.

A structure of the fixing belt 20 will be specifically described later in (3). The fixing belt 20 is extended and stretched around a tension roller 31 and a fixing roller 32 which are provided, as a belt stretching member, in parallel to each other with a spacing, and a downward fixing pad 33 which is provided, as a first photosensitive drum, between the rollers 31 and 32. Each of the tension roller 31 and the fixing roller 32 is shaft-supported rotatably between left and right side plates of a fixing device casing (not shown). The fixing pad 33 is supported and disposed between the left and right side plates of the fixing device casing.

The tension roller 31 is an iron-made hollow roller of 20 mm in outer diameter, 18 mm in inner diameter and 1 mm in thickness, and provides tension to the fixing belt 20.

The fixing roller 32 is an elastic roller, having a high sliding property, which is prepared by forming a silicone rubber elastic layer, as an elastic layer, on an iron alloy-made hollow core metal of 20 mm in outer diameter, 18 mm in inner diameter and 1 mm in thickness. The fixing roller 32 is used as a driving roller into which a driving force is inputted from a driving source (motor) M via an unshown driving gear train, thus being rotationally driven in the clockwise direction of an arrow at a predetermined speed.

By providing the fixing roller 32 with the elastic layer as described above, it is possible to satisfactorily transmit the driving force, inputted into the fixing roller 32, to the fixing belt 20, and at the same time, it is possible to form a fixing nip for ensuring a separating property of the recording material S from the fixing belt 20. Hardness of the silicone rubber is 15 degrees in terms of JIS-A hardness. The silicone rubber elastic layer is also effective in shortening a warming-up time since an amount of heat conduction to the inside is also decreased.

The pressing belt 30 is prepared, in this embodiment, by providing, on a base layer of electroformed nickel, a 30 μm-thick tube of PFA, which is a fluorine-containing resin material, as a surface parting layer. In FIG. 2, the pressing belt 30 is located below the fixing belt 20 and is disposed in the following manner. That is, the pressing belt 30 is extended and stretched around a tension roller 34 and a pressing roller 35 which are provided, as a belt stretching member, in parallel to each other with a spacing, and a upward fixing belt 36 which is provided, as a second photosensitive drum, between the rollers 34 and 35. Each of the tension roller 34 and the pressing roller 35 is shaft-supported rotatably between left and right side plates of a fixing device casing (not shown).

The tension roller 34 is prepared by forming a silicone sponge layer for decreasing a degree of heat conduction from the pressing belt 30 by decreasing heat conductivity, on an iron alloy-made hollow core metal of 20 mm in outer diameter, 16 mm in inner diameter and 2 mm in thickness. The fixing roller 32 is used as the pressing roller 35 is an iron alloy-made hollow rigid roller, having a low sliding property, of 20 mm in outer diameter, 16 mm in inner diameter and 2 mm in thickness. The pressing roller 35 is supported and disposed between the left and right side plates of the fixing device casing.

Further, in order to form a fixing nip 40 as an image heating portion between the fixing belt 20 and the pressing belt 30, the pressing roller 35 is pressed at each of left and right end portions of a rotation shaft thereof by a pressing mechanism (not shown) toward the fixing belt 20 in an arrow F direction at predetermined pressure.

Further, in order to obtain a width fixing nip 40 without upsizing the fixing device, the pressing pad 36 is employed. That is, the fixing belt 20 is pressed toward the pressing belt 30 by the fixing pad 33, and at the same time, the pressing belt 30 is pressed toward the fixing belt 20 by the pressing pad 36. The pressing pad 36 is pressed toward the fixing pad 33 in an arrow G direction at predetermined pressure by a pressing mechanism (not shown). The fixing belt 20 and the pressing belt 30 are press-contacted to each other between the fixing pad 33 and the pressing pad 36, so that the wide fixing nip 40 is formed with respect to the recording material conveyance direction.

The fixing pad 33 includes a pad substrate and a slidable sheet (low-friction sheet) 38 contacted to the fixing belt inner surface. The pressing pad 36 includes a pad substrate and a slidable sheet 39 contacted to the pressing belt inner surface. This is because in the case where the belt base layer is formed of metal, there is a problem that an amount of abrasion (wearing) of a portion of the pad sliding on the inner peripheral surface of the belt is large. By interposing each of the slidable sheets 38 and 39 between the belt and the pad substrate, the abrasion of the pad can be prevented and it is also possible to reduce sliding resistance, and therefore it is possible to ensure a good belt travelling property and a good belt durability.

As a heating means for the fixing belt 20, a heating source (induction heating member, exciting coil) of an electromagnetic induction heating type having high energy efficiency is employed. An induction heating member 37 as the heating source is provided, with a slight gap, opposed to an outer surface of an upper-side belt portion of the fixing belt 20.

The induction heating member 37 is constituted by an induction coil 37*a*, an exciting core 37*b* and a coil holder 37*c* for holding the coil and the core. The induction coil 37*a* is wound in an elongated circular and flat shape by using Litz wire and is provided in the exciting core 37*b* formed in a downward E shape projected to a central portion and end portions of the induction coil 37*a*. The exciting core is formed by using a material, having high magnetic permeability and low residual magnetic flux density, such as ferrite or permalloy, and therefore loss the induction coil 37*a* and the exciting coil can be suppressed, so that it is possible to efficiently heat the fixing belt 20.

A fixing operation is as follows. A control circuit portion 43 drives a motor M at least during execution of image formation. Further, a high-frequency current is passed from an exciting circuit 44 through the induction coil 37*a* of the induction heating member 37.

By driving the motor M, the fixing roller 32 is rotationally driven. As a result, the fixing belt 20 is rotationally driven in the same direction as the fixing roller 32. A peripheral speed of the fixing belt 20 is slightly slower than a conveyance speed of the recording material (sheet) S conveyed from the image forming portion in order to form a loop on the recording material S in a recording material entrance side of the fixing nip 40. In this embodiment, the peripheral speed of the fixing belt 20 is 300 mm/sec, so that a full-color image can be formed on an A4-sized sheet at a rate of 70 sheets/min.

The pressing belt 30 is rotated by the rotation of the fixing belt 20 by a frictional force with the fixing belt 20 at the fixing nip 40. Here, by employing a constitution in which a downstreammost portion of the fixing nip 40 is conveyed by sandwiching the fixing belt 20 and the pressing belt 30 between the roller pair 32 and 35, slip of the belt can be prevented. The downstreammost portion of the fixing nip 40 is a portion where a maximum pressure distribution (with respect to the recording material conveyance direction) at the fixing nip 40 is obtained.

On the other hand, by passing the high-frequency current from the exciting circuit 44 through the induction coil 37*a* of the induction heating member 37, the metal layer of the fixing belt 20 generates heat, so that the fixing belt 20 is heated. A surface temperature of the fixing belt 20 is detected by a temperature detecting element 42 such as a thermistor. A signal relating to the temperature of the fixing belt 20 detected by the temperature detecting element 42 is inputted into the control circuit portion 43. The control circuit portion 43 controls electric power supplied from the exciting circuit 44 to the induction coil 37*a* so that temperature information inputted from the temperature detecting element 42 is maintained at a predetermined fixing temperature, thus controlling the temperature of the belt 20 at the predetermined fixing temperature.

In a state in which the fixing belt 20 is rotationally driven and is increased up to the predetermined fixing temperature to be temperature-controlled, into the fixing nip 40 between the fixing belt 20 and the pressing belt 30, the recording material S on which the unfixed toner image t is carried is conveyed. The recording material S is introduced with the surface, toward the fixing belt 20, where the unfixed toner image t is carried. Then, the recording material S is nipped and conveyed through the fixing nip 40 while intimately contacting the outer peripheral surface of the fixing belt 20 at the unfixed toner image carrying surface thereof, so that the recording material S is supplied with heat and pressure from the fixing belt 20, and thus the unfixed toner image t is fixed on the surface of the recording material S.

Further, the fixing roller 32 in the fixing belt 20 in the elastic roller having the rubber layer, and the pressing roller 35 in the pressing belt 30 is the iron alloy-made rigid roller, and therefore a degree of deformation of the fixing roller 32 is large at an exit of the fixing nip 40 between the fixing belt 20 and the pressing belt 30. As a result, also the fixing belt 20 is larger deformed, so that the recording material S on which the fixed toner image is carried is curvature-separated from the fixing belt 20 by its own resilience. At the fixing nip exit, a separation assisting claw member 41 is provided.

(3) Fixing Belt 20

Part (a) of FIG. 3 is schematic sectional view showing a layer structure of the fixing belt 20 as the fixing member. The fixing belt 20 includes a cylindrical substrate 20*b*, an inner surface slidable layer 20*a* provided on an inner peripheral surface of the cylindrical substrate 20*b*, a primer layer 20*c* which coats an outer peripheral surface of the cylindrical substrate 20*a*, and a cylindrical elastic layer 20*d* provided on the primer layer 20*c*. A fluorine-containing resin tube 20*f* as a fluorine-containing resin surface layer is provided over the elastic layer 20*d* via a silicone rubber adhesive layer 20*e*. Further, laser-irradiated regions L are provided on the elastic layer 20*d* at end portions of the fixing belt 20. Part (b) of FIG. 3 is a schematic view showing the laser-irradiated regions L of the elastic layer 20*d*.

The fixing belt 20 in this embodiment is a laminated composite layer member having the above-mentioned 6 layers, and is a thin member having flexibility as a whole and low thermal capacity. Further, the fixing belt 20 holds a substantially cylindrical shape in a free state thereof. The respective constituent layers will be specifically described below.

(3-1) Cylindrical Substrate 20*b*

The fixing belt 20 is required to have heat resistance (property), and therefore the cylindrical substrate 20*b* may preferably be formed of a material which is considered in terms of properties of heat resistance and flexing resistance. For example, as the material, it is possible to use metals such as aluminum, iron, nickel or copper; alloys of these metals; heat-resistant resins such as polyimide resin, polyamide resin, polyether ether ketone resin or polyamide imide resin; and polymer alloys of these resins.

In this embodiment, as the cylindrical substrate 20*b*, an electroformed nickel belt of 55 mm in inner diameter, 65 μm in thickness and 420 mm in length was used.

(3-2) Inner Surface Slidable Layer 20*a*

As a material for the inner surface slidable layer 20*a*, a resin material, such as polyimide resin, having high durability and high heat resistance is suitable. In this embodiment, a polyimide precursor solution obtained by reaction, in an organic polar solvent, of aromatic tetracarboxylic dianhydride or its derivative with aromatic diamine in a substantially equimolecular amount was applied onto the inner surface of the cylindrical substrate 20*b*. Thereafter, the solution was dried and heated to form a polyimide resin layer by dewatering cyclization reaction, thus preparing the inner surface slidable layer 20*a*.

Specifically, in this embodiment, as the polyimide precursor solution, a solution of a polyimide precursor, in N-methyl-2-pyrrolidone, obtained from 3,3',4,4'-biphenyltetracarboxylic dianhydride and para-phenylenediamine was used. Then, a 15 μm-thick inner surface slidable layer 20*a* was formed of the polyimide resin.

(3-3) Elastic Layer 20*d*

The elastic layer 20*d* functions as an elastic layer, to be carried by the fixing member, for applying uniform pressure to an uneven (projection/recess) portion generated between the toner image and the sheet (recording material) during the fixing. In order to achieve the function, the elastic layer 20*d* is not limited particularly, but in view of processing property, the elastic layer 20*d* may preferably be prepared by curing a silicone rubber of an addition curing type. This is because elasticity of the elastic layer 20*d* can be adjusted by adjusting a degree of crosslinking of the silicone rubber depending on a type and addition amount of a filler described later.

In general, the addition curing type silicone rubber contains organopolysiloxane having an unsaturated aliphatic group, organopolysiloxane having active hydrogen bonded to silicon, and a platinum compound as a crosslinking catalyst.

The organopolysiloxane having active hydrogen bonded to silicon forms a crosslinking structure by reaction with an alkenyl group of the organopolysiloxane (component) having the unsaturated aliphatic group by the action of the catalyst of the platinum compound.

The silicone rubber elastic layer 20*d* may contain the filler for improving a heat conduction property, a reinforcing property and a heat resistance property of the fixing member.

Particularly, for the purpose of improving the heat conduction property, the filler may preferably have a high heat conduction property. Specifically, as the filler, it is possible to use an inorganic substance, particularly metal and a metal compound.

Specific examples of the high heat conductive filler may include silicon carbide (SiC), silicon nitride ($Si_3N_4$), boron nitride (BN), aluminum nitride (AlN), alumina ($Al_2O_3$), zinc oxide (ZnO), magnesium oxide (MgO), silica ($SiO_2$), copper (Cu), aluminum (Al), silver (Ag), iron (Fe), nickel (Ni) and the like.

These materials can be used singly or in mixture of two or more species. An average particle size of a high heat conductive filler may preferably be 1 μm or more and 50 μm or less from the viewpoints of handling and dispersibility. Further, as a shape of the filler, it is possible to use a spherical shape, a pulverized shape, a needle shape, a plate shape, a whisker shape and the like, but the spherical shape is preferred from the viewpoint of the dispersibility.

From the viewpoints of contribution to surface hardness of the fixing member and efficiency of heat conduction to the unfixed toner during the fixing, a preferred range of the thickness of the silicone rubber elastic layer 20*d* is 100 μm or more and 600 μm or less, particularly 200 μm or more and 500 μm or less.

In this embodiment, the addition curing type silicone rubber was applied (coated) in a thickness of 450 μm and was baked at 200° C. for 30 min. In this case, a stock solution of the addition curing type silicone rubber was obtained by mixing the following ingredients (a) and (b) so that a ration of the number of vinyl groups to Si—H group (H/Vi) is 0.45, and then by adding the platinum compound in a catalyst amount into the mixture.

(a) vinylated polydimethylsiloxane having two or more vinyl groups per molecule (weight-average molecular weight: 100000 (polystyrene basis))

(b) hydrogen organopolysiloxane having two or more Si—H bonds per molecule (weight-average molecular weight: 1500 (polystyrene basis))

(3-4) Primer Layer 20*c*

Primer treatment refers to formation, on the surface of the cylindrical substrate 20*b*, of a primer for bonding the cylindrical substrate 20*b* and the elastic layer 20*d* in a state in which an adhesive performance can be achieved.

A material constituting the primer layer 20*c* is required to have a softening point and a melting point which are lower than those of the materials for the inner surface slidable layer 20*a*, the cylindrical substrate 20*b* and the fluorine-containing resin surface layer 20*f* and to have good wettability with the cylindrical substrate 20*b* compared with the silicone rubber elastic layer 20*d*. For example, as the material for the primer layer 20*c*, it is possible to use a hydroxyl-based (Si—H based) silicone primer, a vinyl-based silicone primer, an alkoxy-based silicone primer, and the like. With respect to the hydroxyl-based (Si—H based) silicone primer and the vinyl-based silicone primer, the primer is bonded to the silicone rubber elastic layer 20*d* by addition polymerization crosslinking. With respect to the alkoxy-based silicone primer, the primer is bonded to the silicone rubber elastic layer 20*d* by condensation polymerization crosslinking.

More specifically, the silicone primer is a mixture of a primer composition as a silane coupling agent with an organic solvent.

The primer composition is divided into an adhesive component and a film-forming component in many cases. Examples of the adhesive component may include organoalkoxysilane having alkenyl group, organoalkoxypolysiloxane resin, and the like.

Specifically, the adhesive component is an organosilicon compound having, in a molecule shown below, both of a reactive group (such as alkoxy group or silanol group) to be chemically bonded to the inorganic substance and a reactive group (such as vinyl group, epoxy group, methacrylic group, acrylic group, amino group or mercapto group) to be chemically bonded to an organic material.

Examples of the molecule may include vinyltrimethoxysilane, vinyltriethoxysilane, γ-methacryloxypropyltrimethoxysilane, γ-glycidoxypropyltrimethoxysilane, γ-aminopropyl-triethoxysilane, and γ-mercaptopropyltrimethoxysilane.

Examples of the film-forming component may include an organosilicon compound having alkoxy group, silanol group or the like in a large amount, and may specifically include tetraethoxysilane and the like. The silanol group in the primer (in this case, alkoxy group is converted into silanol group by hydrolysis) performs the function of forming a film by being chemically bonded to the silanol group of the primer layer itself, the silanol group of the silicone rubber elastic layer or the inorganic substance.

As the solvent for the primer composition, an easy-volatilizable solvent is preferred. Examples of the solvent may include alcohols such as methanol, ethanol and isopropanol; aromatic hydrocarbon solvents such as toluene; aliphatic hydrocarbon solvents such as heptane, n-hexane, cyclohexane, methylcyclohexane and dimethylcyclohexane; ketone solvents such as acetone and methyl ethyl ketone; and ester solvents such as ethyl acetate.

These solvents may be used singly or in mixture of two or more species. With respect to an addition amount of the solvent, depending on a coating method of the primer composition, the addition amount may appropriately be adjusted so as to provide a proper concentration of the primer composition. The solvent amount in the primer composition may desirably be two times or more the amount, of the component other than the solvent, on a weight basis, so that thickness non-uniformity can be made less when the cylindrical substrate 20*b* is coated with the silicone primer.

In this embodiment, a hydroxyl-based silicone primer ("DY 39-051 A/B", manufactured by Dow Corning Toray Co., Ltd.) was applied in an intended thickness of 5.0 μm and then was baked at 200° C. for 5 min.

(3-5) Formation of Silicone Rubber Elastic Layer

FIG. 4 shows an example of a step of forming the silicone rubber elastic layer (cylindrical elastic layer) 20*d* over the cylindrical substrate 20*b* on which outer peripheral surface the primer layer 20*c* is formed, and is a schematic view for illustrating a method using a so-called ring-coating (method).

The addition curing type silicone rubber composition in which the addition curing type silicone rubber and the filler are mixed is charged into a cylinder pump 57, and then is pressure-fed from the cylinder pump 57 to a ring-shaped coating head 53. As a result, the addition curing type silicone rubber composition is applied onto the peripheral surface of the primer layer 20*c* (not shown in FIG. 4 but is formed on the surface of the cylindrical substrate 20*b*) from a coating liquid supply nozzle (not shown) provided inside the ring-shaped coating head 53. The coating head 53 is held by a fixed coating head holding portion 54. The cylinder pump 57 is driven by a motor M1 to press-feed the addition curing type silicone rubber composition to the coating head 53 via a tube 56.

The cylindrical substrate 20*b* (exactly the structure consisting of the layers 20*a*, 20*b* and 20*c*) is externally fitted and held around a cylindrical core metal held by a core metal holding tool (fixture) 51. The core metal holding tool 51 is held by a coating table 52 so that an axis thereof is horizontal, and thus is horizontally movable. The ring-shaped coating head 53 is coaxially and externally fitted around the cylindrical substrate 20*b*. The coating table 52 is reciprocated in a horizontal axis direction of the core metal holding tool 51 at a predetermined speed by a motor M2.

Simultaneously with the coating by the coating head 53, by moving (reciprocating) the cylindrical substrate 20*b* in a right direction in FIG. 4, a coated film (layer) 55 of the addition curing type silicone rubber composition can be cylindrically formed on the peripheral surface of the cylindrical substrate 20*b*.

A thickness of the coated film 55 can be controlled by a clearance between the coating liquid supply nozzle and the cylindrical substrate 20*b*, a supplying (feeding) speed of the silicone rubber composition, a moving speed of the cylindrical substrate 20*b*, and the like. In this embodiment, a 450 μm-thick silicone rubber composition layer 55 was obtained by setting the clearance between the coating liquid supply nozzle and the cylindrical substrate 20*b* at 0.8 mm, the supplying speed of the silicone rubber composition at 2.9 mm/sec, and the moving speed of the cylindrical substrate 20*b* at 40 mm/sec.

The addition curing type silicone rubber composition layer 55 formed on primer layer 20*c* (formed on the cylindrical substrate 20*b*) is heated for a certain time by a heating means such as electric furnace to cause crosslinking reaction, so that the silicone rubber elastic layer 20*d* can be formed.

(3-6) Fluorine-Containing Resin Surface Layer 20*f*

As the surface layer 20*f* of the fixing member, from the viewpoints of a molding property and a toner parting property, a fluorine-containing resin tube formed by extrusion molding is used.

As the fluorine-containing resin material as a starting material of the fluorine-containing resin tube, a tetrafluoroethylene/perfluoroalkylvinyl ether copolymer (PFA) excellent in heat resistance is suitably used. A thickness of the fluorine-containing resin tube may preferably be 50 μm or less. This is because elasticity of the silicone rubber elastic layer 20*d* formed below the surface layer 20*f* can be maintained when the surface layer 20*f* is laminated, and thus it is possible to suppress excessively high surface hardness of the fixing member.

The inner surface of the fluorine-containing resin tube can be improved in adhesive property by being subjected to sodium treatment, excimer laser treatment, ammonia treatment, or the like.

The fluorine-containing resin tube used is formed by the extrusion molding. A type of copolymerization of a starting material for PFA is not limited particularly but may include, e.g., random copolymerization, block copolymerization, graft copolymerization, and the like.

Further, a content molar ratio between tetrafluoroethylene (TFE) and perfluoroalkylvinyl ether (PAVE) which are the starting material for PFA is not limited particularly. For example, the content molar ratio of TFE/PAVE may suitably be 94/6 to 99/1.

As other fluorine-containing resin materials, it is possible to use tetrafluoroethylene/hexafluoropropylene copolymer (FEP), polytetrafluoroethylene (PTFE), ethylene/tetrafluoroethylene copolymer (ETFE), polychlorotrifluoroethylene (PCTFE), ethylene/chlorotrifluoroethylene copolymer (ECTFE), polyvinylidene fluoride (PVDF), and the like. These fluorine-containing resin materials can be used singly or in combination of two or more species.

In this embodiment, the PFA tube obtained by the extrusion molding was used. A thickness of the rube was 40 μm. An inner diameter of the tube was smaller than an outer diameter of the elastic layer 20*d*, and was 52 mm. An inner surface of the rube has been subjected to the ammonia treatment in order to improve the adhesive property.

(3-7) Adhesive Layer 20*e*

The adhesive layer 20*e* for fixing the fluorine-containing resin tube as the surface layer 20*f* over the cured silicone rubber elastic layer as the elastic layer 20*d* is constituted by a cured material of an addition curing type silicone rubber adhesive uniformly applied in a thickness of 1-10 μm on the surface of the elastic layer 20*d*. The addition curing type silicone rubber adhesive 20*e* contains an addition curing type silicone rubber in which a self-adhesive component is mixed.

Specifically, the addition curing type silicone rubber adhesive 20*e* contains organopolysiloxane having unsaturated hydrocarbon group represented by vinyl group, hydrogen organopolysiloxane, and a platinum compound as a crosslinking catalyst. The adhesive 20*e* is cured (hardened) by addition reaction. As such an adhesive 20*e*, a known adhesive can be used.

In this embodiment, an addition curing type silicone rubber adhesive ("SE 1819 CV A/B, manufactured by Dow Corning Toray Co., Ltd.) was used.

(3-8) Laser-Irradiated

In order to suppress the tube peeling generated from the interface, as a starting point, between the elastic layer 20*d* and the fluorine-containing resin tube 20*f* (via the adhesive layer 20*e*) at end portions of the fixing belt 20, it is preferable that bonding strength (adhesive force) is increased. This step is characterized in that the laser-irradiated regions L are formed at the fixing belt end portions in order to achieve sufficient bonding strength, with the result that the tube peeling from the belt and portions is suppressed.

The laser-irradiated region L may preferably be formed with at least one non-laser-irradiated region with respect to a circumferential direction of the fixing belt 20 in order to permit easy squeezing (removal) of the adhesive and the air in a squeeze step described later (i.e., a step in which an excessive adhesive which does not contribute to the adhesive bonding and the air taken (included) during coating). When laser light is continuously outputted from a laser without providing the non-laser-irradiated region with respect to a full-circumference direction, there is the case where the prepared fixing belt 20 causes thickness non-uniformity. The laser is capable of locally and easily perform surface treatment, and therefore control of the above-described laser-irradiated region is easy.

An oscillation (emission) wavelength λ used in the laser irradiation may preferably be in a range of 120 nm≤λ≤10600 nm. In the case of λ<120 nm, it takes much time to effect repetitive output, so that productivity in a manufacturing step is lowered. Further, in the case of λ=10600 nm, sufficient energy cannot be obtained, so that surface treatment power is lowered.

A mechanism for increasing the bonding strength between the elastic layer 20*d* and the fluorine-containing resin tube 20*f* by the laser irradiation is based on the following effects 1) and 2), so that the bonding strength between the fluorine-containing resin tube 20*f* and the elastic layer 20*d* can be enhanced.

1) Anchor effect by roughening the surface of the elastic layer 20*d*

2) Adhesive retaining effect at the surface layer portion of the elastic layer 20*d* by a change in functional group of the elastic layer 20*d* (surface retention of the adhesive by hydrophilization or suppression, by crosslinking structure formation, of penetration of the addition curing type adhesive into a deep portion of the elastic layer.

The effect 1) is also obtained by using a laser capable of emitting laser light of any oscillation wavelength (λ) within the range of 120 nm≤λ≤10600 nm. According to study the present inventors, an effect of further increasing the bonding strength when an arithmetic average surface roughness Ra in the laser-irradiated region L is in a range of 0.5 μm≤Ra≤10 μm was obtained.

The effect 2) is noticeable in the case of excimer laser, or the like, having a short oscillation wavelength. By the irradiation of the laser, intermolecular bond at the elastic layer surface (or bond between molecules of a substance adhered to a surface of an object to be treated) is cut, so that free radical is formed.

The free radical reacts with water in the air and an adjacent molecular chain, so that hydroxyl group (having a peak in the neighborhood of 3400 $cm^{-1}$ as measured by infrared spectrophotometer according to FT-IR is introduced to the surface of the elastic layer 20*d*, and crosslinking at the elastic layer surface progresses. The hydroxyl group at the elastic layer surface accelerates dewatering condensation reaction with a silane coupling agent or the like in the adhesive, and therefore as a result, it is possible to increase the bonding strength between the fluorine-containing resin tube and the elastic layer.

Further, in the case where the silicone rubber is used as the material for the elastic layer 20*d*, crosslinking (Si—O bond (peak in the neighborhood of 1020 $cm^{-1}$ as measured by infrared spectrophotometer (FT-IR)) of the surface layer progresses. In this case, as described in JP-A 2009-244887, such an effect of suppressing penetration of the addition curing type adhesive into the elastic layer deep portion is also achieved. For that reason, it is possible to effectively prevent improper adhesive bonding due to exhaustion of the adhesive at the elastic layer surface portion.

In this embodiment, under a condition of an oscillation wavelength of 10600 nm, an output of 20 W and an oscillation frequency of 25 kHz, the elastic layer was irradiated with laser light emitted from $CO_2$ laser so that a 15 mm-wide laser-irradiated region was formed with four non-laser-irradiated regions (portions) a each having a length of 5 mm (every 90 degree) with respect to the circumferential direction.

The above-described laser irradiation is summarized as follows.

a: When an initial surface roughness of the cylindrical elastic layer 20*d* is Ra(before) and a surface roughness of the cylindrical elastic layer 20*d* in the laser-irradiated region L is Ra(after), Ra(before)<Ra(after) is satisfied.

b: Ra(after) is 0.5 μm or more and 10 μm or less.

c: In the case where a silicone rubber is used as the material for the cylindrical elastic layer 20*d*, when an intensity ratio of (absorption resulting from Si—O bond in the neighborhood of 1020 $cm^{-1}$)/(absorption resulting from Si—C bond in the neighborhood of 1260 $cm^{-1}$), measured by an infrared spectrophotometer (FT-IR), with respect to the surface of the cylindrical elastic layer 20*d* before being irradiated with the laser light is α(before) and an intensity ratio of (absorption resulting from Si—O bond in the neighborhood of 1020 $cm^{-1}$)/(absorption resulting from Si—C bond in the neighborhood of 1260 $cm^{-1}$), measured by the infrared spectrophotometer (FT-IR), with respect to the surface of the cylindrical elastic layer 20*d* in the laser-irradiated region L is α(after), α(before)<α(after) is satisfied.

d: In the case where a fluorine-containing rubber is used as the material for the cylindrical elastic layer 20*d*, when an intensity ratio of (absorption resulting from hydroxyl bond in the neighborhood of 3400 $cm^{-1}$)/(absorption resulting from C—F bond in the neighborhood of 1210 $cm^{-1}$), measured by an infrared spectrophotometer (FT-IR), with respect to the surface of the cylindrical elastic layer 20*d* before being irradiated with the laser light is β(before) and an intensity ratio of (absorption resulting from hydroxyl bond in the neighborhood of 3400 $cm^{-1}$)/(absorption resulting from C—F bond in the neighborhood of 1210 $cm^{-1}$), measured by the infrared spectrophotometer (FT-IR), with respect to the surface of the cylindrical elastic layer 20*d* in the laser-irradiated region L is β(after), β(before)<β(after) is satisfied.

(4) Fluorine-Containing Resin Tube Coating Method in Embodiment 1 (Expansion Coating Method)

In this embodiment, a method (expansion coating method) in which the fluorine-containing resin tube as the surface layer 20*f* is expanded from an outside thereof, and then the elastic layer 20*d* is coated with the fluorine-containing resin tube via the adhesive layer 20*e*, was used.

Parts (a) to (l) of FIG. 5 are schematic step views when the cylindrical substrate 20*b* over which the silicone rubber elastic layer 20*d* is laminated is coated with the fluorine-containing resin tube 20*f* by the expansion coating method, over. The cylindrical substrate 20*b* on which the primer layer 20*c* and the silicone rubber elastic layer 20*d* are laminated is set on a core (not shown), and then the silicone rubber elastic layer 20*d* is coated with the fluorine-containing resin tube 20*f* disposed on an inner surface of a tube expansion mold K. Flow of the expansion coating method will be described with reference to (a) to (l) of FIG. 5 showing the following steps (a) to (l), respectively.

(a) Rubber Coating

In this step, the silicone rubber elastic layer as the elastic layer 20*d* is formed in the above-described manner over the outer peripheral surface of the cylindrical substrate 20*b* provided with the inner surface slidable layer 20*a* at the inner peripheral surface of the cylindrical substrate 20*b* and the primer layer 20*c* at the outer peripheral surface of the cylindrical substrate 20*b*.

(b) Laser Irradiation

In this step, the silicone rubber elastic layer 20*d* is irradiated with the laser light at a predetermined portion thereof in the above-described manner so as to form predetermined laser-irradiated regions L.

(c) Adhesive Coating (Application)

In this step, the silicone rubber elastic layer 20*d* subjected to the laser irradiation is uniformly coated with the addition curing type adhesive layer 20*e* in the above-described manner.

(d) Tube Insertion

In this step, the fluorine-containing resin tube 20*f* as the surface layer is disposed inside (inserted into) the metal-made tube expansion mold K having an inner diameter larger than an outer diameter of the cylindrical substrate 20*b* provided with the inner surface slidable layer 20*a*, the primer layer 20*c*, the silicone rubber elastic layer 20*d* and the adhesive layer 20*e* which are obtained in the steps (a) to (c). Then, the fluorine-containing resin tube 20*f* is held at end portions thereof by using holding members Fu and Fl.

(e) Increase in Diameter of Tube

In this step, a portion of a gap (spacing) a between the outer surface of the fluorine-containing resin tube 20*f* and the inner surface of the expansion mold K is placed in a vacuum state (state of negative pressure relative to ambient pressure. In the vacuum state (5 kPa), the fluorine-containing resin tube 20*f* is expanded (increased in diameter), so that the outer surface of the fluorine-containing resin tube 20*f* intimately contacts the inner surface of the expansion mold K.

(f) Insertion

In this step, on the core (not shown), the cylindrical substrate 20*b* provided with the inner surface slidable layer 20*a*, the primer layer 20*c*, the silicone rubber elastic layer 20*d* and the adhesive layer 20*c* which are obtained in the steps (a) to (c) is set, and then the resultant structure is inserted into the fluorine-containing resin tube 20*f* in the state in which the fluorine-containing resin tube 20*f* is increased in diameter by the expansion mold K in the step (e).

The inner diameter of the metal-made tube expansion mold K is not limited particularly when the inner diameter is in a range in which the insertion of the above structure (including the cylindrical substrate 20*b*) is smoothly performed.

(g) Tube Coating

In this step, after the insertion step (f), the vacuum state (state of the negative pressure relative to the ambient pressure) in which the gap portion between the outer surface of the fluorine-containing resin tube 20*f* and the inner surface of the expansion mold K is eliminated (removed). By eliminating the vacuum state, the increased diameter of the fluorine-containing resin tube 20*f* is decreased to a diameter which is the same as the outer diameter of the structure (including the layers 20*a* to 20*e*). As a result, the fluorine-containing resin tube 20*f* and the silicone rubber elastic layer 20*d* are bonded via the adhesive layer 20*e* so as to create an intimate coat state.

Thereafter, as described in JP-A 2010-143118, it is also possible to insert a step in which the fluorine-containing resin tube 20*f* is elongated in a longitudinal direction thereof so as to provide a predetermined elongation (percentage). When the fluorine-containing resin tube 20*f* is elongated, the addition curing type silicone rubber adhesive layer 20*e* disposed between the fluorine-containing resin tube 20*f* and the silicone rubber elastic layer 20*d* performs the function of a lubricant, so that the fluorine-containing resin tube 20*f* can be smoothly elongated.

(h) Squeezing Step

A structure including the members (layers) 20*a* to 20*f* is pulled out of the expansion mold K. Between the elastic layer 20*d* and the fluorine-containing resin tube 20*f*, the excessive addition curing type silicone rubber adhesive (layer) 20*e* which does not contribute to the bonding and the air taken (included) during the coating are present. For that reason, a squeezing step for squeezing (removing) the excessive adhesive and the air may preferably be performed.

An air-jetting ring R having an inner diameter slightly larger than an outer diameter of the cylindrical substrate 20*b* over which the fluorine-containing resin tube 20*f* via the adhesive layer 20*e* is fixed is externally fitted around the cylindrical substrate 20*b*. Then, the air-jetting ring R is moved from an upper end portion of the cylindrical substrate 20*b* in the longitudinal direction of the fluorine-containing resin tube 20*f* while jetting the air (air pressure: 0.5 MPa) onto the surface of the fluorine-containing resin tube 20*f*.

As a result, the excessive addition curing type silicone rubber adhesive 20*e*, which does not contribute to the bonding, and the air taken during the coating which are present between the elastic layer 20*d* and the fluorine-containing resin tube 20*f* are squeezed out (removed).

Here, in the laser-irradiated region L, a degree of the bonding between the elastic layer 20*d* is strong, and therefore, as shown in (b) of FIG. 3, when the elastic layer 20*d* is continuously irradiated with the laser light with respect to a full-circumference direction, the addition curing type silicone rubber adhesive 20*e* and the air to be squeezed out at the portion are subjected to resistance. However, in this embodiment, the laser irradiation is made so that at least one non-laser-irradiated region (non-laser-irradiated portion) a is provided with respect to the circumferential direction, the addition curing type silicone rubber adhesive 20*e* and the air can pass through the non-laser-irradiated region a, so that the above-described resistance is alleviated.

As the squeezing method, other than the method using the air pressure, a liquid or semi-solid may also be jetted. Further, the squeezing may also be made by using an expanding and contracting ring having a diameter smaller than the outer diameter of the cylindrical substrate 20*b* coated with the fluorine-containing resin tube 20*f*.

(i) Heating (Treatment)

After the squeezing step (h), by effecting heating (at 200° C. for 30 minutes in an electric furnace), the addition curing type silicone rubber adhesive 20*e* was cured (hardened), so that the fluorine-containing resin tube 20*f* and the elastic layer 20*d* were fixed over the entire region via the cured adhesive 20*e*.

(j) Cut into Product Length (Cut and Polishing)

In this step, after the heating, a resultant structure (20*a*-20*f*) was, after being naturally cooled, cut into a predetermined length so that the laser-irradiated regions L are located at end portions thereof and then was polished (abraded) to complete preparation of the fixing belt 20.

(5) Comparison Example with Embodiment 1

As Comparison examples with Embodiment 1, fixing belts (fixing members) in Comparison examples 1-1 to 1-3 were prepared by the above-described expansion coating method in which preparation conditions of layer structures other than the fluorine-containing resin tube are the same, and in which conditions only in the coating step of the fluorine-containing resin tube 20*f* are changed, as shown in Table 1 appearing hereinafter, in terms of "(presence or absence of or range of) laser irradiation" and "adhesive amount".

In Comparison example 1-1, the fixing member prepared without irradiating the elastic layer 20*d* with the laser light is used. In Comparison example 1-2, the fixing member prepared without irradiating the elastic layer 20*d* with the laser light and by increasing the adhesive amount to twice that in Embodiment 1, i.e., 6 g is used. In Comparison example 1-3, the fixing member prepared by continuously irradiating the elastic layer 20*d* with the laser light in the entire region with no laser-irradiated region with respect to the circumferential direction of the elastic layer 20*d*.

(6) Thickness Measurement

By using a micrometer ("High-accuracy Digimatic Micrometer MDH-25M, manufactured by Mitsutoyo Corp.), a belt thickness was measured at a position of 20 mm from each of longitudinal ends of the fixing belt (fixing member) to calculate a value obtained by subtracting a minimum from a maximum. Here the position of 20 mm is a position adjacent to the laser-irradiated region in Embodiment 1 and Comparison example 103, which is a region where there is a high possibility that the adhesive remains in the squeezing step (h) described above. A result is also shown in Table 1.

In Embodiment 1 in which the laser-irradiated region L is provided with the non-laser-irradiated region a with respect to the circumferential direction, a thickness non-uniformity of 10 μm which is comparative to those in Comparison examples 1-1 and 1-2 in which there is no laser irradiation was only obtained, so that the fixing belt was finished with high accuracy.

In Comparison example 1-3 in which the laser irradiation was made continuously with respect to the full-circumference direction, the bonding strength between the elastic layer 20*d* and the fluorine-containing resin tube 20*f* at the laser-irradiated portion is strong. For that reason, the addition curing type silicone rubber adhesive 20*e* disposed between the elastic layer 20*d* and the fluorine-containing resin tube 20*f* was not able to be satisfactorily squeezed out (removed), so that a remarkable thickness uniformity of 3305 μm (nearly equal to 3.3 mm) was observed.

(7) Adhesive Property Test

A adhesive property between the elastic layer 20*d* and the fluorine-containing resin tube 20*f* (via the adhesive layer 20*e*) was evaluated by using a peeling measurement machine ("Vertical Auto-Measuring Stand MV-1000N", manufactured by Imada Co., Ltd.).

Specifically, cutting is provided, by a feather cutter, at an interface between the elastic layer 20*d* and the fluorine-containing resin tube 20*f* at an end portion of the fixing belt. Then, the fluorine-containing resin tube 20*f* was pulled at the cutting portion by the test machine (peeling measurement machine) in a state of 1 mm/sec in pulling speed and 10 mm in sample width, thus measuring a 90 degree peeling strength at the interface between the elastic layer 20*d* and the fluorine-containing resin tube 20*f*.

With respect to the pulling direction, peeling from the belt end portion in a real machine was assumed, and the measurement was made by pulling the fluorine-containing resin tube 20*f* in the pulling direction as shown in (a) of FIG. 7 so that the peeling progressed in the longitudinal direction as shown in (a) and (b) of FIG. 7. A result is also shown in Table 1.

With respect to the fixing member in Embodiment 1, the peeling strength of 6.5 N was obtained, so that it was confirmed that the elastic layer 20*d* and the fluorine-containing resin tube 20*f* were firmly bonded via the elastic layer 20*e*.

With respect to the fixing members in Comparison examples 1-1 and 1-2 in which there was no laser-irradiated, the peeling strength was in the neighborhood of 4.0 N, so that a weak bonding strength was obtained. Further, the increase in adhesive amount from that in Comparison example 1-1 to that in Comparison example 1-2 resulted in such that the increase did not directly affect the bonding strength.

With respect to the fixing member in Comparison example 1-3 in which the laser irradiation was made continuously with respect to the full-circumference direction, the peeling strength was 6.0 N which was somewhat weaker than that in Embodiment 1. This is presumably because due to residual stress generated by the thickness non-uniformity at the stagnated portion of the adhesive, compared with Embodiment 1, the tube is liable to be peeled.

TABLE 1

| EX*1 | CM*2 | LI*3 | PHT*4 | TTE*5 | STE*6 |
|---|---|---|---|---|---|
| EMB. 1 | EC | NLIR | 3 g | 10 μm | 6.5 N |
| CE 1-1 | EC | N | 3 g | 11 μm | 3.9 N |
| CE 1-2 | EC | N | 6 g | 12 μm | 3.9 N |
| CE 1-3 | EC | FULL | 3 g | 3305 μm | 6.0 N |

*1"EX" represents Embodiment or Comparison example, and "CE 1-1" to "CE 1-3" are Comparison example 1-1 to Comparison example 1-3, respectively.
*2"CM" represents the coating method, and "EC" is the expansion coating.
*3"LI" represent the laser-irradiated.
"NLIR" shows that the laser irradiation is made every 90 degrees with non-laser-irradiated region a.
"N" shows that the laser irradiation is not made.
"FULL" shows that the laser irradiation is made continuously with respect to the full-circumference direction.
*4"AA" represents the adhesive amount (8).
*5"TN" represents the thickness-nonuniformity (μm) .
*6"BS" represents the bonding strength (N).

Embodiment 2

In this embodiment, a fixing belt 20 was prepared in the same manner as in Embodiment 1 except that the coating step of the fluorine-containing resin tube 20*f* was changed.

(1) Fluorine-Containing Resin Tube Coating Method in Embodiment 2 (Lubrication Coating Method)

In this embodiment, a method (lubrication coating method) in which the coating of the fluorine-containing resin tube 20*f* over the elastic layer 20*d* was made by using the adhesive layer 20*e* as a lubricant.

Parts (a) to (j) of FIG. 6 are schematic step views when the cylindrical substrate 20*b* over which the silicone rubber elastic layer 20*d* is laminated is coated with the fluorine-containing resin tube 20*f* by the lubrication coating method.

Steps of (a) rubber coating, (b) l laser irradiation and (c) adhesive coating are the same as those shown in FIG. 5 in Embodiment 1.

(d) Tube Coating

In this step, on the core (not shown), the cylindrical substrate 20*b* provided with the inner surface slidable layer 20*a*, the primer layer 20*c*, the silicone rubber elastic layer 20*d* and the adhesive layer 20*c* which are obtained in the steps (a) to (c) is set, and then the resultant structure is coated (externally engaged) with the fluorine-containing resin tube 20*f* as the surface layer.

(e) Upper-Side Tube Fixing

In this step, the structure (20*a*-20*f*) is press-heated by a metal block M from an outside of the fluorine-containing resin tube 20*f* in the laser-irradiated region L in an upper end side (one end side) of the structure. As a result, the fluorine-containing resin tube 20*f* and the silicone rubber elastic layer 20*d* are fixed in the upper side (one side) via the adhesive layer 20*e*.

(f) Squeeze

Thereafter, in order to adjust a thickness of the adhesive layer 20*e*, the excessive addition curing type silicone rubber adhesive remaining between the elastic layer 20*d* and the fluorine-containing resin tube 20*f* is removed by being squeezing with an air-jetting ring R. In this case, the squeezing step and a tube elongation step can also be performed concurrently.

(g) Lower-Side Tube Fixing

Then, in this step, the fluorine-containing resin tube 20*f* is fixed in a lower side (the other side) by the press heating similarly as in the upper-side tube fixing step (e) described above. The fixing positions at the end portions are appropriately selected from portions other than a sheet passing region when the fluorine-containing resin tube 20*f* is used as the fixing belt.

(h) Heating (Treatment)

Then, in this step, by heating the structure for a predetermined time by a heating means such as an electric furnace, the addition curing type silicone rubber adhesive 20*e* is cured (hardened), so that the fluorine-containing resin tube 20*f* and the silicone rubber elastic layer 20*d* were fixed over the entire region via the cured adhesive 20*e*.

(i) Cut into Product Length

Finally, in this step, a resultant structure (20*a*-20*f*) is cut into a desired length at end portions thereof, so that it is possible to obtain the fixing belt 20 as the fixing member in the present invention.

(2) Comparison Example with Embodiment 2

As Comparison examples with Embodiment 2, fixing belts (fixing members) in Comparison examples 2-1 to 2-3 were prepared by the above-described expansion coating method in which preparation conditions of layer structures other than the fluorine-containing resin tube are the same, and in which conditions only in the coating step of the fluorine-containing resin tube 20*f* are changed, as shown in Table 1 appearing hereinafter, in terms of "(presence or absence of or range of) laser irradiation" and "adhesive amount".

In Comparison example 2-1, the fixing member prepared without irradiating the elastic layer 20*d* with the laser light is used. In Comparison example 2-2, the fixing member prepared without irradiating the elastic layer 20*d* with the laser light and by increasing the adhesive amount to twice that in Embodiment 2, i.e., 10 g is used. In Comparison example 2-3, the fixing member prepared by continuously irradiating the elastic layer 20*d* with the laser light in the entire region with no non-laser-irradiated region with respect to the circumferential direction of the elastic layer 20*d*.

(3) Thickness Measurement

The thickness was measured by using the same method as in (6) in Embodiment 1. A result is also shown in Table 2.

In Embodiment 2 in which the laser-irradiated region L is provided with the non-laser-irradiated region a with respect to the circumferential direction, a thickness non-uniformity of 13 μm which is comparative to those in Comparison examples 2-1 and 2-2 in which there is no laser irradiation was only obtained, so that the fixing belt was finished with high accuracy.

In Comparison example 2-3 in which the laser irradiation was made continuously with respect to the full-circumference direction, the bonding strength between the elastic layer 20*d* and the fluorine-containing resin tube 20*f* at the laser-irradiated portion is strong. For that reason, the addition curing type silicone rubber adhesive 20*e* disposed between the elastic layer 20*d* and the fluorine-containing resin tube 20*f* was not able to be satisfactorily squeezed out (removed), so that a remarkable thickness uniformity of 4395 μm (nearly equal to 4.4 mm) was observed.

(4) Adhesive Property Test

An adhesive property test was conducted by using the same method as in (7) in Embodiment 1.

With respect to the fixing member in Embodiment 2, the peeling strength of 6.8 N was obtained, so that it was confirmed that the elastic layer 20*d* and the fluorine-containing resin tube 20*f* were firmly bonded via the elastic layer 20*e*.

With respect to the fixing members in Comparison examples 2-1 and 2-2 in which there was no laser-irradiated, the peeling strength was in the neighborhood of 4.0 N, so that a weak bonding strength was obtained. Further, the increase in adhesive amount from that in Comparison example 2-1 to that in Comparison example 2-2 resulted in such that the increase did not directly affect the bonding strength.

With respect to the fixing member in Comparison example 2-3 in which the laser irradiation was made continuously with respect to the full-circumference direction, the peeling strength was 5.8 N which was somewhat weaker than that in Embodiment 2. This is presumably because due to residual stress generated by the thickness non-uniformity at the stagnated portion of the adhesive, compared with Embodiment 2, the tube is liable to be peeled.

TABLE 2

| EX*1 | CM*2 | LI*3 | PHT*4 | TTE*5 | STE*6 |
|---|---|---|---|---|---|
| EMB. 2 | LC | NLIR | 5 g | 12 μm | 6.8 N |
| CE 2-1 | LC | N | 5 g | 13 μm | 4.0 N |
| CE 2-2 | LC | N | 10 g | 14 μm | 4.1 N |
| CE 2-3 | LC | FULL | 5 g | 4395 μm | 5.8 N |

*1"EX" represents Embodiment or Comparison example, and "CE 2-1" to "CE 2-3" are Comparison example 2-1 to Comparison example 2-3, respectively.
*2"CM" represents the coating method, and "LC" is the lubrication coating.
*3"LI" represent the laser-irradiated.
"NLIR" shows that the laser irradiation is made every 90 degrees with the non-laser-irradiated region a.
"N" shows that the laser irradiation is not made.
"FULL" shows that the laser irradiation is made continuously with respect to the full-circumference direction.
*4"AA" represents the adhesive amount (8).
*5"TN" represents the thickness-nonuniformity (μm).
*6"BS" represents the bonding strength (N).

Other Embodiments (1) In Embodiments 1 and 2, as the fixing member for the image heating fixing device, the heating member 20 as the heating means for heating the image in contact with the image carrying surface of the recording material was described. Also with respect to the pressing member 30 which is the other fixing member for forming the fixing nip 40 with the heating member 20, in the case where a constitution including the cylindrical elastic layer and the fluorine-containing resin tube coating over the cylindrical elastic layer is employed, a similar effect can be obtained by applying the present invention to the constitution.

(2) In Embodiments 1 and 2, as the fixing member, the endless belt member was described, but the fixing member is not limited thereto. As the fixing member, a roller-shaped member including a roller-shaped or hollow roller-shaped base substrate having rigidity, the cylindrical elastic layer 20*d* formed over the outer peripheral surface of the base substrate, and the fluorine-containing resin tube coating over the surface of the elastic layer 20*d* may also be used.

(3) In the image heating fixing device A, other than the device for fixing or temporarily fixing the unfixed toner image (visualized image or developer image) as a fixed image by heating the unfixed toner image by using the fixing member, also a device for modifying a surface property such as gloss by re-heating the fixed toner image is included.

According to the present invention, it is possible to obtain the fixing member which does not readily generate the creases and cracks on the surface thereof even when the fixing member is repetitively used.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 237942/2012 filed Oct. 29, 2012, which is hereby incorporated by reference.

What is claimed is:

1. A fixing member comprising:

an elastic layer; and a toner parting layer, wherein said elastic layer includes a laser-irradiated region formed by being irradiated at longitudinal end portions of said elastic layer with laser light except for at least one non-laser-irradiated region with respect to a circumferential direction of said elastic layer, and wherein said elastic layer is coated with said toner parting layer.

2. A fixing member according to claim 1, wherein said toner parting layer is formed of a fluorine-containing resin material.

3. A fixing member according to claim 1, wherein when a surface roughness of said elastic layer before being irradiated with the laser light is Ra(before) and a surface roughness of said elastic layer in the laser-irradiated region is Ra(after), the following condition is satisfied:

$$Ra(\text{before}) < Ra(\text{after}).$$

4. A fixing member according to claim 3, wherein Ra(after) is 0.5 μm or more and 10 μm or less.

5. A fixing member according to claim 1, wherein in the case where a silicone rubber is used as a material for said elastic layer, when an intensity ratio of (absorption resulting from Si—O bond in the neighborhood of 1020 $cm^{-1}$)/(absorption resulting from Si—C bond in the neighborhood of 1260 $cm^{-1}$), measured by an infrared spectrophotometer (FT-IR), with respect to the surface of said elastic layer before being irradiated with the laser light is α(before) and an intensity ratio of (absorption resulting from Si—O bond in the neighborhood of 1020 $cm^{-1}$)/(absorption resulting from Si—C bond in the neighborhood of 1260 $cm^{-1}$), measured by the infrared spectrophotometer (FT-IR), with respect to surface of said elastic layer in the laser-irradiated region is α(after), the following condition is satisfied:

$$\alpha(\text{before})<\alpha(\text{after}).$$

6. A fixing member according to claim 1, wherein in the case where a fluorine-containing rubber is used as a material for said elastic layer, when an intensity ratio of (absorption resulting from hydroxyl bond in the neighborhood of 3400 $cm^{-1}$)/(absorption resulting from C—F bond in the neighborhood of 1210 $cm^{-1}$), measured by an infrared spectrophotometer (FT-IR), with respect to the surface of said elastic layer before being irradiated with the laser light is β(before) and an intensity ratio of (absorption resulting from hydroxyl bond in the neighborhood of 3400 $cm^{-1}$)/(absorption resulting from C—F bond in the neighborhood of 1210 $cm^{-1}$), measured by the infrared spectrophotometer (FT-IR), with respect to the surface of said elastic layer in the laser-irradiated region is β(after), the following condition is satisfied:

$$\beta(\text{before})<\beta(\text{after}).$$

7. A fixing member manufacturing method comprising:

a step of forming a laser-irradiated region by irradiating an elastic material at longitudinal end portions of the elastic material with laser light of an oscillation wavelength λ of 120 nm≤λ10600 with at least one non-laser-irradiated region with respect to a circumferential direction;

a step of applying an adhesive onto the elastic material on which the laser-irradiated region is formed;

a step of coating a resin tube on the elastic material on which the adhesive is applied; and a step of fixing the resin tube by curing the adhesive.

8. A fixing member manufacturing method according to claim 7, further comprising a step of cutting a longitudinal end portion, of the fixing member, where the laser-irradiated region is formed.

9. A fixing member manufacturing method according to claim 7, wherein when a surface roughness of the elastic material before being irradiated with the laser light is Ra(before) and a surface roughness of the elastic material in the laser-irradiated region is Ra(after), the following condition is satisfied:

$$Ra(\text{before})<Ra(\text{after}).$$

10. A fixing member manufacturing method according to claim 9, wherein Ra(after) is 0.5 μm or more and 10 μm or less.

11. A fixing member manufacturing method according to claim 7, wherein in the case where a silicone rubber is used as the elastic material, when an intensity ratio of (absorption resulting from Si—O bond in the neighborhood of 1020 $cm^{-1}$)/(absorption resulting from Si—C bond in the neighborhood of 1260 $cm^{-1}$), measured by an infrared spectrophotometer (FT-IR), with respect to the surface of the elastic material before being irradiated with the laser light is α(before) and an intensity ratio of (absorption resulting from Si—O bond in the neighborhood of 1020 $cm^{-1}$)/(absorption resulting from Si—C bond in the neighborhood of 1260 $cm^{-1}$), measured by the infrared spectrophotometer (FT-IR), with respect to the surface of the elastic material in the laser-irradiated region is α(after), the following condition is satisfied:

$$\alpha(\text{before})<\alpha(\text{after}).$$

12. A fixing member manufacturing method according to claim 7, wherein in the case where a fluorine-containing rubber is used as the elastic material, when an intensity ratio of (absorption resulting from hydroxyl bond in the neighborhood of 3400 $cm^{-1}$)/(absorption resulting from C—F bond in the neighborhood of 1210 $cm^{-1}$), measured by an infrared spectrophotometer (FT-IR), with respect to the surface of the elastic material before being irradiated with the laser light is β(before) and an intensity ratio of (absorption resulting from hydroxyl bond in the neighborhood of 3400 $cm^{-1}$)/(absorption resulting from C—F bond in the neighborhood of 1210 $cm^{-1}$), measured by the infrared spectrophotometer (FT-IR), with respect to the surface of the elastic material in the laser-irradiated region is β(after), the following condition is satisfied:

$$\beta(\text{before})<\beta(\text{after}).$$

13. A fixing member manufacturing method according to claim 7, wherein the resin tube is formed of a fluorine-containing resin material.

* * * * *